US010709174B2

(12) United States Patent
Stephan et al.

(10) Patent No.: US 10,709,174 B2
(45) Date of Patent: Jul. 14, 2020

(54) GARMENT FOR A NEWBORN, IN PARTICULAR A PREMATURE BABY

(71) Applicant: Fritz Stephan GmbH Medizintechnik, Gackenback (DE)

(72) Inventors: Heike Stephan, Oberelbert (DE); Jana Zimmermann, Bad Ems (DE)

(73) Assignee: Fritz Stephan GmbH Medizintechnik, Gackenback (DE)

( * ) Notice: Subject to any disclaimer, the term of this patent is extended or adjusted under 35 U.S.C. 154(b) by 401 days.

(21) Appl. No.: 15/246,265

(22) Filed: Aug. 24, 2016

(65) Prior Publication Data

US 2017/0055592 A1 Mar. 2, 2017

(30) Foreign Application Priority Data

Aug. 25, 2015 (DE) ..... 10 2015 010 874

(51) Int. Cl.

| | |
|---|---|
| ***A41D 11/00*** | (2006.01) |
| ***A41B 13/08*** | (2006.01) |
| ***A41B 13/06*** | (2006.01) |
| ***A41D 13/12*** | (2006.01) |

(52) U.S. Cl.

CPC ..... *A41B 13/06* (2013.01); *A41D 13/1272* (2013.01); *A41B 2400/32* (2013.01); *A41B 2500/52* (2013.01); *A41D 2200/20* (2013.01)

(58) Field of Classification Search

CPC . A41B 13/06; A41B 2400/32; A41B 2500/52; A41B 13/00; A41B 13/065; A41D 13/1272; A41D 2200/20; A47G 9/083

USPC ..... 2/69.5, 75, 80, 111, 69; 5/923

See application file for complete search history.

(56) References Cited

U.S. PATENT DOCUMENTS

| | | | | |
|---|---|---|---|---|
| 1,373,378 A * | 3/1921 | Backmann | ..... | A41B 13/06 2/69 |
| 3,739,399 A * | 6/1973 | Sheahon | ..... | A41B 13/06 2/69.5 |
| 4,083,064 A | 4/1978 | Schneider | | |
| 4,979,250 A * | 12/1990 | Troncone | ..... | A41B 13/06 2/69 |
| 6,817,033 B2 * | 11/2004 | Bailey | ..... | A41B 13/06 2/69.5 |

(Continued)

FOREIGN PATENT DOCUMENTS

| | | | | |
|---|---|---|---|---|
| DE | 202011004399 U1 * | 6/2011 | ..... | A41B 13/06 |
| EP | 2543269 | 1/2013 | | |

OTHER PUBLICATIONS

English machine translation of DE 202011004399 U1 via espacenet.com. Translation performed on Sep. 17, 2018.*

*Primary Examiner* — Jameson D Collier

(74) *Attorney, Agent, or Firm* — Lowe Graham Jones PLLC

(57) ABSTRACT

The invention relates to a garment (1) for a newborn (3) made from a film-like material, comprising a back portion (2) to be placed under the back, a leg portion (4) for placing under the legs and two wing elements (6, 8) for swathing a chest, arm and abdominal region of the newborn (3), wherein the leg portion (4) is arranged adjacent to the back portion (2) and the two wing elements (6, 8) are arranged adjacent to the back portion (2) on the arm side, wherein the leg portion (4) is designed together with a leg-cover portion (5) as a pouch element having an opening (10) facing the back portion (2) for inserting the legs of the newborn (3).

5 Claims, 5 Drawing Sheets

(56) References Cited

U.S. PATENT DOCUMENTS

| | | | | |
|---|---|---|---|---|
| 7,287,676 | B2 * | 10/2007 | Chua | A41B 13/06 2/69 |
| 8,257,417 | B2 * | 9/2012 | Chen | A61F 7/02 607/108 |
| 9,326,888 | B2 * | 5/2016 | Chen | A61F 7/02 |
| 2003/0003107 | A1 * | 1/2003 | Farmer | A01N 63/00 424/184.1 |
| 2005/0150047 | A1 * | 7/2005 | Trani | A41B 13/06 5/482 |
| 2008/0149674 | A1 * | 6/2008 | Hiniduma-Lokuge | A47D 13/025 224/159 |
| 2010/0010599 | A1 * | 1/2010 | Chen | A61F 7/02 607/112 |
| 2010/0300459 | A1 * | 12/2010 | Lair | A61B 50/30 128/853 |
| 2012/0234877 | A1 * | 9/2012 | Hiniduma-Lokuge | A47D 13/025 224/159 |
| 2012/0311762 | A1 * | 12/2012 | Aiken | A41B 13/06 2/69.5 |
| 2012/0330388 | A1 * | 12/2012 | Chen | A61F 7/02 607/112 |
| 2013/0036536 | A1 * | 2/2013 | Breindahl | A41B 13/06 2/455 |
| 2013/0333113 | A1 * | 12/2013 | Gotel | A41B 13/06 5/494 |
| 2014/0020176 | A1 * | 1/2014 | Coates | A41B 13/06 5/494 |
| 2014/0033430 | A1 * | 2/2014 | Daugherty | A41B 13/06 5/494 |
| 2016/0081863 | A1 * | 3/2016 | Belsinger, Jr. | A61G 1/003 128/872 |

* cited by examiner

GARMENT FOR A NEWBORN, IN PARTICULAR A PREMATURE BABY

PRIORITY CLAIM

This application claims priority from German Patent Application No. 10 2015 010 874.3, filed Aug. 25, 2015, the contents of which are incorporated herein.

FIELD OF THE INVENTION

The invention relates to a garment for a newborn or a premature baby according to the precharacterising clause of claim 1.

BACKGROUND OF THE INVENTION

Newborns, in particular premature babies, need an environment which maintains energy and water balances in a manner similar to an in-utero environment in the womb of the mother. Disturbances to the energy and water balance lead to increased mortality and morbidity, reduce growth rates and have other unfavorable effects.

Conventional incubators, heat lamps and heatable mattresses do not provide the option of enabling full access to the newborn for therapeutic or nursing intervention and at the same time maintaining a constant climate for the newborn.

Garments for newborns, in which a newborn is enclosed by a film-like material to protect it from cold and dehydration, are already known from the prior art. These garments are generally substantially square or rectangular in design, with a back side and a front side which are connected to one another at the edges. However, printed document U.S. Pat. No. 4,083,064 also describes an embodiment which is realized in the form of a shirt.

The various embodiments from the prior art have a high rigidity which, particularly in the case of a PE material, leads to the formation of folds which can cause damage to the skin, for example by pressure points. A certain degree of noise caused by rustling when swaddling the newborn and a lack of external access to the newborn are furthermore disadvantageous. In particular, it is crucial that the newborn is received quickly into a protective environment immediately after the birth. However, this is difficult in the case of known garments, which means that valuable seconds are lost.

Printed document EP 2,543,269 A1 discloses a neonatal cover which has various small windows that can be closed by a removable film to enable access to the newborn from the outside. This type of garment is substantially square in shape with a front and back side, wherein a closable lateral length of the square can be opened completely so that a newborn can be placed therein, whilst an adjacent lateral length of the square has a smaller opening in a central region through which the head of the newborn can peer out. This embodiment is disadvantageous in that the insertion of the newborn is very difficult, possibly resulting in injuries.

It is therefore the object of the present invention to provide a garment for a newborn or a premature baby which eliminates the risk of injury present in the prior art, and which can be placed on a newborn more easily. Access to the newborn from the outside should also remain possible.

SUMMARY OF THE INVENTION

This object is achieved according to the invention by a garment for a newborn which is made from a film-like material. The garment comprises a back portion to be placed under the back, a leg portion for placing under the legs and two wing elements for swathing the chest, arm and abdominal region of the newborn, with the leg portion being arranged adjacent to the back portion and the two wing elements being arranged adjacent to the back portion on the arm side. The key idea behind the invention is that the wing elements are formed such that a respective wing element can be wrapped from the back portion on the arm side over an arm of the newborn so that this arm along with the neighboring shoulder, the abdominal region and the chest of the newborn are completely covered by this wing element. This is advantageous since covering by wrapping enables particularly good adaptation to the skin of the newborn. It is clearly more comfortable than the square designs of the prior art. As a result of the abdominal and chest region being covered by the expanse of both wing elements during the wrapping procedure, it is possible to wrap a respective wing element over one arm and one shoulder of the newborn in such a way that the other shoulder and the other arm in each case are not covered by this wing element. This is advantageous since it is thus possible to cover the newborn with only one wing element so that the other side is accessible, whilst the chest and abdominal region of the newborn are still covered. The double covering of the abdominal and chest region when both wing elements are wrapped advantageously enables the wing elements to be held particularly well without the need for a separate closing element. It is thus advantageously possible to quickly provide a protective environment for a newborn. A newborn is placed on the back portion within a few seconds and in two movements, the wing elements are also wrapped. This is ground-breaking over known garments in which it is necessary to close a zip fastening or to implement a special enveloping procedure.

In a further advantageous embodiment, the film-like material comprises a preferably transparent plastics material, particularly preferably PE film, PVC, biopolymers or polyurethane, especially particularly preferably polyurethane. It is advantageous here to select a material composition which is transparent, since newborns, particularly premature babies, are to a great extent still observed and assessed visually. An unobstructed view of the skin of the newborn is therefore necessary. A further requirement of the material composition is that it is as water-vapor-tight as possible. A saturated water-vapor atmosphere forms inside the garment, which prevents the skin from becoming dehydrated. The material should furthermore preferably be very thin and light so that the weight does not hinder the newborn in terms of its breathing or movement. The material should nevertheless be advantageously tear-resistant so that nursing procedures do not cause damage to the garment. A further preferred requirement is a very soft feel so that sharp folds do not form and the skin of the newborn is therefore not harmed, which also enables easier positioning of the newborn. In this case, the material nestles lightly around the body. The material should furthermore advantageously enable easy and rapid swathing of the newborn and adaptation to the body through optimized shaping, for example by means of wings and a hood. The material should furthermore preferably be a low-rustle material so that the still sensitive hearing of the newborn does not induce any unnecessary stress during nursing procedures. In terms of the said features, a thin polyurethane film of preferably only a few micrometers has proven particularly advantageous. Although polyurethane has a low water-vapor permeability, which is why this material has hitherto also found no relevant use in the prior art, a comparison with other garments of the prior art has shown that the advantages clearly prevail. This is because the garment according to the invention is soft to the touch and nestles around the body, whilst other garments from the prior art are clearly more rigid and unbend again automatically. The garment according to the invention makes only a very slight rustling noise, whereas garments from the prior art exhibit loud rustling and crackling.

In a further advantageous embodiment, the leg portion is designed together with a leg-cover portion as a pouch element having an opening facing the back portion for inserting the legs of the newborn.

The design of a leg portion together with a leg-cover portion as a pouch element enables simple positioning of the newborn. At the same time, the legs of the newborn are therefore covered directly and thus also protected against the environment. The two wing elements are advantageously constructed in a plane with the back portion on the arm side. This is advantageous since, in this way, the wing elements do not pose a hindrance to positioning the newborn and this latter can be introduced easily into the pouch element by the legs and placed with its back on the back portion. Subsequent swathing of the chest, arm and abdominal region of the newborn is thus possible by means of the two wing elements.

The leg portion also merges advantageously into the back portion in a film plane. This is advantageous since the newborn therefore comes to lie on a smooth surface without seams. The pouch portion advantageously tapers in the direction away from the newborn. The shape therefore adapts particularly well to a leg region of a newborn. The newborn is able both to stretch out the legs and to tuck them into a drawn-in position, similar to a cross-legged position, also referred to as a fetal position The leg portion advantageously has laterally rounded pouch edge curves on a side facing the newborn. This is advantageous for preventing a risk of injury to the newborn. In terms of its shape, the leg-cover portion particularly preferably resembles the leg portion. The newborn is thus advantageously received between the leg portion and the leg-cover portion in a water-vapor atmosphere for the purpose of stabilizing the core body temperature. Seams are preferably incorporated at the lateral edges between the leg portion and the leg-cover portion. This is advantageous since the leg-cover portion is thereby prevented from slipping as a result of the newborn kicking. The seams are preferably present on both lateral edges, in each case only in a sub-region of the overall length, particularly preferably adjacent to a lateral edge which is remote from the newborn. This is advantageous since, in spite of the lateral connection between the leg portion and the leg-cover portion, a large part of the leg-cover portion thus remains free at the lateral ends and therefore readily adaptable to the body shape of the newborn.

In a further advantageous embodiment, the garment comprises a head portion for placing under the head of the newborn, which is arranged adjacent to the back portion. This is advantageous since the head of the newborn is thereby also protected on its underside facing the lying surface. This head portion is preferably connected to the back portion in a film plane. This is advantageous since it is thus possible to position the newborn particularly comfortably. It is conceivable here for the head portion to be in the shape of a semi-circle in which the opening of the semi-circle faces the back portion in the centre. This enables particularly good adaptation to the shape of the head of the newborn in material-saving manner. The back portion advantageously protrudes over the head portion so that the shoulders of the newborn can also be positioned in a particularly advantageous manner. The shoulder edges here are preferably aligned parallel to a width direction of the newborn as limiting edges of the back portion.

In a further advantageous embodiment, the head portion is designed together with a head-cover portion as a hood element having an opening facing the back portion for inserting the head of the newborn, preferably in such a way that the face of the newborn is uncovered. This is particularly advantageous since, in this way, the head can also be covered by the hood shape so that it is possible to protect against evaporation to stabilize the core body temperature of the newborn. The head portion and the head-cover portion are advantageously connected to one another by a seam. It is thus possible to let the head portion merge into the back portion in a film plane and still form a hood element.

The mouth and nose region advantageously remains uncovered in the garment. This enables unimpeded access to this region and unimpeded visual contact with the parents. The garment is manufactured from a plastics material which is advantageously impermeable to water vapor and is suitable for long-term contact with the skin of the newborn.

In a further advantageous embodiment, the wing elements are realized in a shape resembling the wings of a sparrowhawk and initially have an increasing head-to-toe extent in the outwards direction from the back portion on the arm side and then converge in each case to form a wing tip. The initially increasing shape enables the entire chest and abdominal region of the newborn to be covered from the side, with the subsequent shape converging into a wing tip advantageously enabling the respective opposite arm of a wing element to be left free. Likewise, the initially increasing shape also enables the opening of the pouch element to be covered. Therefore, other desirable shapes are also conceivable if they are able to advantageously cover important regions of the newborn accordingly, including circular shapes, angular shapes and also shapes in arbitrary patterns.

The dimensions of the head-to-toe extent and the lateral extent of the wing elements are particularly preferably adapted to the size of the newborn. The progression of the upper edge of the wing element here is preferably designed initially as an upper wing edge adjoining the shoulder edge, with this upper wing edge being aligned approximately in the direction of the legs of the newborn from the back portion outwards, albeit virtually parallel to a lateral direction. In this way, during the wrapping procedure, one shoulder of the newborn is advantageously covered whilst the upper wing edge then lies over a neck region of the newborn without covering the other shoulder. The advantage here lies in the rounded upper wing edge at the neck region. This is advantageous since, in this way, the entire chest region of the newborn is covered. An outer upper wing edge is therefore likewise preferably recommended which is aligned more markedly outwards in the direction of a leg region of the newborn so that, during the wrapping procedure, this outer upper wing edge lies along an opposite arm of the newborn, with this arm remaining free from the side. A wing tip is therefore advantageously recommended which merges into a lower outer wing edge which advantageously extends below the opening of the pouch element in a wrapped state. Subsequently directed from the outside inwards, there is advantageously a rounded lower wing edge which merges into an inner lower wing edge which lies along a lateral line of the pouch element during the wrapping procedure so that an opening of the pouch element is advantageously completely covered by the wing element. The overall description of the shape should preferably not be regarded as restrictive.

Quick and easy swathing of the newborn and adaption to the body is advantageously possible as a result of the shaping with wings and a hood. The arms, legs and head can be exposed separately whilst the rest of the body remains covered.

In a further advantageous embodiment, the garment comprises wrap elements arranged on the leg portion on the arm side for the purpose of optionally swathing the legs of the newborn in an accessible manner. This is advantageous since it is thus possible to place the newborn on top of the leg-cover portion and to cover its leg region with the wrap elements. The legs of the newborn are thus accessible from an underside. In terms of its shape, an edge of a wrap element which adjoins the wing element is preferably designed to be complementary to the shape of a lower edge of the wing element. This can therefore be manufactured and cut particularly easily. A lateral edge is preferably arranged parallel to a head-to-toe extent of the newborn here, whilst a lower edge extends particularly advantageously parallel to a lateral width direction of the newborn. The wrap element can thus be folded particularly advantageously inwards over the pouch element and thereby cover a leg region of the newborn.

In a further advantageous embodiment, the wrap elements stretch outwards from the leg portion on the arm side to such an extent that they overlap when they are wrapped towards the centre over the leg-cover portion so that the legs of the newborn can also be accommodated in the space between the leg-cover portion and the wrap elements and are externally accessible from the side.

In a further advantageous embodiment, the wing elements overlap the wrap elements in the wrapped state, so that the arm, shoulder, chest, abdominal and leg regions of the newborn are also completely covered when the legs are accommodated in the space between the leg-cover portion and the wrap elements. Such a design of the wing elements constitutes an especially clear representation of the particularly advantageous character of the invention. The garment enables numerous variations in terms of application and accommodating the newborn. Combinations of the individual wrap elements in the covered or uncovered state are therefore possible so that certain regions of the newborn are accessible without causing lasting disruption to the microclimate of the other regions of the newborn.

In a further advantageous embodiment, an inner side of the garment is populated by physiological microorganisms. The skin of newborns, and in particular premature babies, differs from that of full-term babies and adults. It is still immature and substantially thinner in terms of its layers than normal skin. As a result, the newborn loses substantially more water via the skin. This transdermal water loss has a quite dramatic influence on the water balance and the thermal regulation of the newborn. In addition, the missing or less developed epithelial layer and its cornification means that there is a high risk of injury to the skin through "plasters", electrodes, sharp seams or friction. This injured skin along with the rapid dehydration when it is not adequately mature induces entry points for bacteria and germs. In the hospital, these germs are mostly pathogenic germs which are often highly resistant to antibiotics.

Early bacterial population by natural microbes therefore plays a significant role for the newborn, in particular for the premature baby. Depending on the area of the body, a dense film of commensal microorganisms, i.e. bacteria and fungi, are physiologically found on the skin of a person. These microorganisms exist on human skin without damaging it, moreover providing the natural protective acid mantle and ensuring natural protection against pathogenic, i.e. aggressive and disease-causing, germs.

However, the population by physiologically acting microorganisms does not occur until the first days and weeks of life. Therefore, in the initial neonatal period, pathogenic germs have the optimum opportunity to populate the neonatal skin and to penetrate it owing to the vulnerability of the dry skin. In addition, particularly premature babies require aggressive antibiotic therapy in an intensive care unit due to possible accompanying illnesses, which antibiotics disturb the natural microflora and can therefore further promote pathogenic population.

Coating the inside of the replaceable plastics garment with physiological bacteria, e.g. microbes from its own mother which it would otherwise acquire over the course of time, would therefore be a very promising option for promoting and accelerating the build-up of natural microflora on the skin of the newborn and therefore protecting against life-threatening skin infections on-site.

A particular advantage of the garment is that the torso, head and limbs of the newborn are enclosed by a water-impermeable garment in such a way that the water evaporation from the actual skin finds an environment saturated with water vapor. The evaporative water loss from the skin, which can exceed the urine rate in the case of immature premature babies in dry air, is thereby advantageously reduced to virtually 0. However, it is at the same time preferably readily possible to gain full access to the important nursing regions of the newborn, such as the face, which is free, and the genital region, readily accessible via the leg insert, and the limbs, by opening the respective wing or wrap. Regions of the garment are advantageously designed in such a way that they enable visual and mechanical access to the newborn as required for diagnostic and nursing procedures. Further advantages and functions are revealed in the description below in conjunction with the drawings. All of the features disclosed here form the subject-matter of the invention in useful combination, and also independently of their combination, in the individual exemplary figures, which show as follows.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
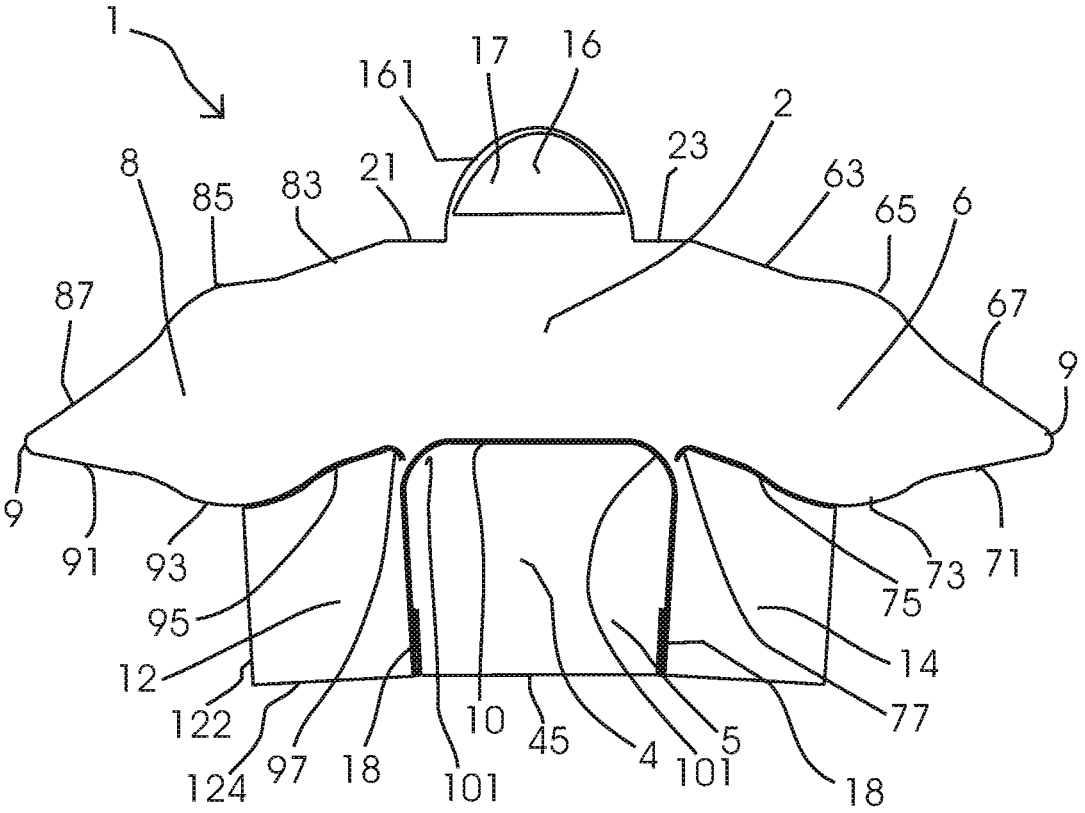
FIG. 1: an opened-out view of the finished garment.

FIG. 1 shows a garment 1 having a back portion 2, wing elements 6, 8, having a leg portion 4 and leg-cover portion 5 and having wrap elements 12, 14 and a head portion 16. Arranged over the head portion 16, there is furthermore a head-cover portion 17 which, in this view, is not directly differentiable from the head portion 16. Together with the leg portion 4, the leg-cover portion 5 forms a pouch element which comprises an opening 10 directed towards the back portion 2. Furthermore located on a side of the pouch element which is remote from the opening 10 is a pouch fold point 45 which connects the leg portion 4 to the leg-cover portion 5 on this side. Arranged laterally between the leg-cover portion 5 and the leg portion 4 are pouch seams 18, which do not extend along the entire lateral edge here but only along a part of the lateral edge which is remote from the back portion 2. In this case, the lateral pouch edge 103 merges into an edge region of the opening 10 along a lateral upper pouch edge curve 101. With this, a width of the leg-cover portion 5 tapers from the back portion 2 to the side which is remote therefrom along the lateral edge 103. The wrap elements 12, 14, which are arranged laterally thereto on the leg-cover portion 5, each have, on their lateral edge 122, a parallel edge extending in the head-to-toe direction. Furthermore, on the foot side of the newborn, they have a lower edge 124 of the wrap element 12, 14 which extends parallel to a width direction. In the direction towards the back portion 2 or the wing element 6, 8, an edge shape of a pouch element 12, 14 is designed to be complementary to an edge shape of the wing element 6, 8. The head portion 16 is connected to the head-cover portion 17 by way of a hood seam 161 extending along a semi-circular shape. The head portion 16 is in the shape of a semi-circle which faces with its open semi-circle side towards the back portion 2. However, the back portion 2 protrudes laterally over the head portion 16 so that it has shoulder edges 21, 23 extending in the width direction. The wing elements 6, 8 are arranged adjacent to the back portion 2 on the arm side. Adjoining the shoulder edges 21, 23, respective upper wing edges 63, 83 follow in an outward direction from the back portion 2 on the arm side. These are not quite precisely parallel to a width direction, but are angled slightly towards a leg region of the newborn. A rounded upper wing edge 65, 85 follows the upper edge region 63, 68 further outwards. This wing edge serves predominantly for covering the opposite chest side of the newborn 3 in the wrapped state. Following further outwards from the rounded upper wing edge 65, 85 is an outer upper wing edge 67, 87, at which the wing elements 6, 8 converge in the head-to-toe extent to form a respective wing tip 9. The side of the back portion 2 which faces the leg portion 4 is likewise adjoined by edges of the wing elements 6, 8 in the width direction. That is to say, a respective lower wing edge curve 77, 97 of the wing element 6, 8 leads to the lateral upper pouch edge curve 101 of the leg-cover portion 5. This wing edge curve produces a brief narrowing of the respective wing element 6, 8 in the head-to-toe extent, with a widening again being effected further outwards. In this case, the lower wing edge curves 77, 97 merge into an inner lower wing edge 75, 95, which in turn leads into a rounded lower wing edge 73, 93 at its greatest widening. At this point, between the rounded lower wing edge 73, 93 and the rounded upper wing edge 65, 85, the wing elements 6, 8 have the greatest head-to-toe extent of the respective wing element 6, 8 to then converge again further outwards. In this case, the wing elements 6, 8 each have an outer lower wing edge 71, 91 which leads into the wing tip 9 like the outer upper wing edges 67,87. The outer upper wing edge 67, 87 and outer lower wing edge 71, 91 thus converge to the wing tip 9.

Figure 2:
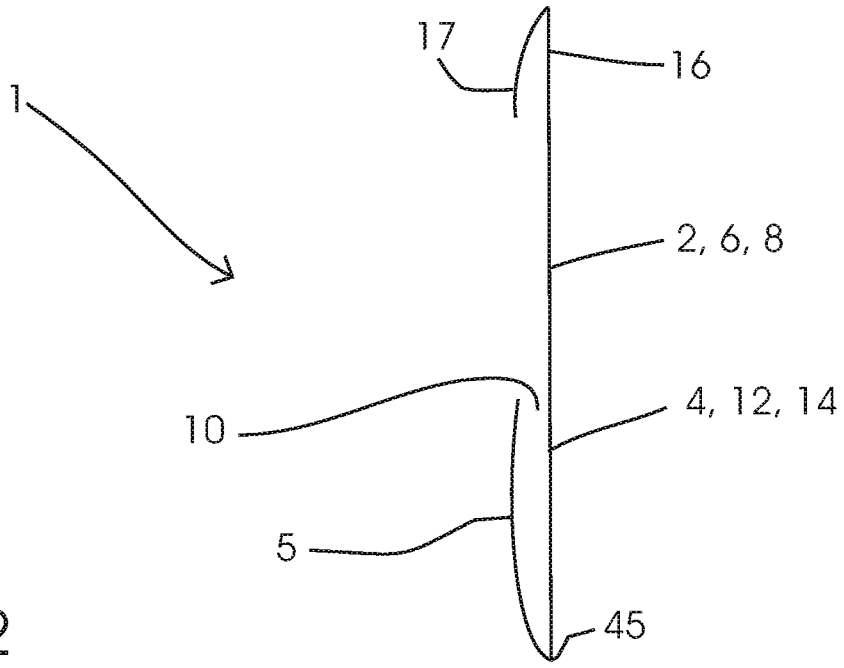
FIG. 2: a lateral cross-sectional view of the garment according to the invention.

FIG. 2 shows a side profile view in which the design of the pouch element with the leg-cover portion 5 and the design of the hood element with the head-cover portion 17 are particularly visible.

Figure 3:
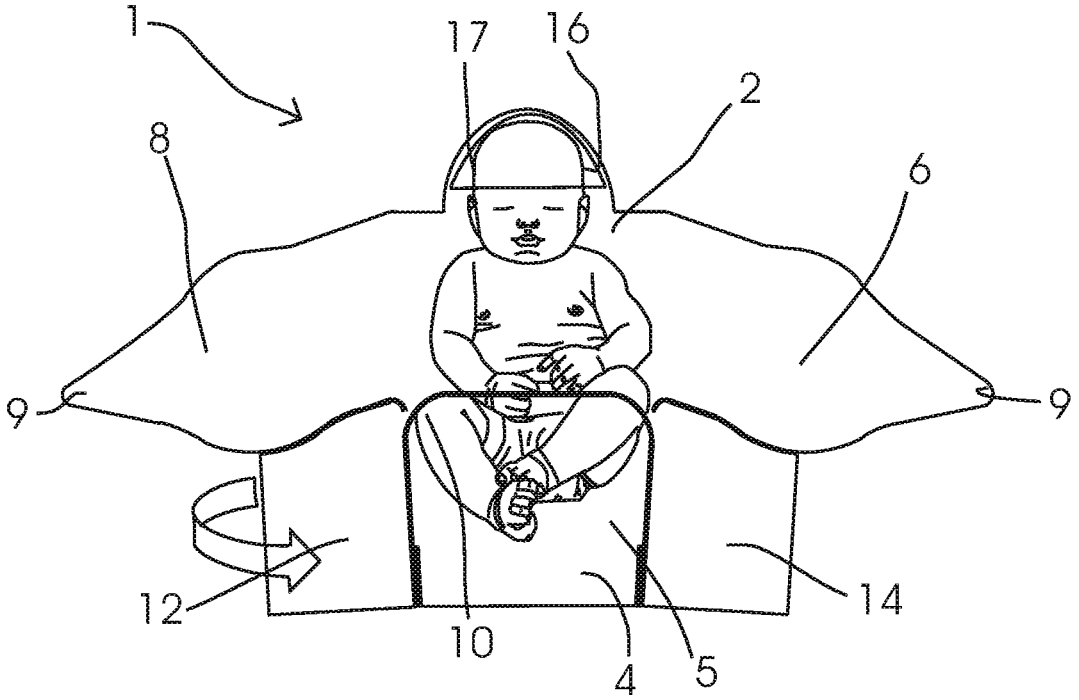
FIG. 3: a newborn with its legs in the pouch element and its head in the hood element.
Figure 4:
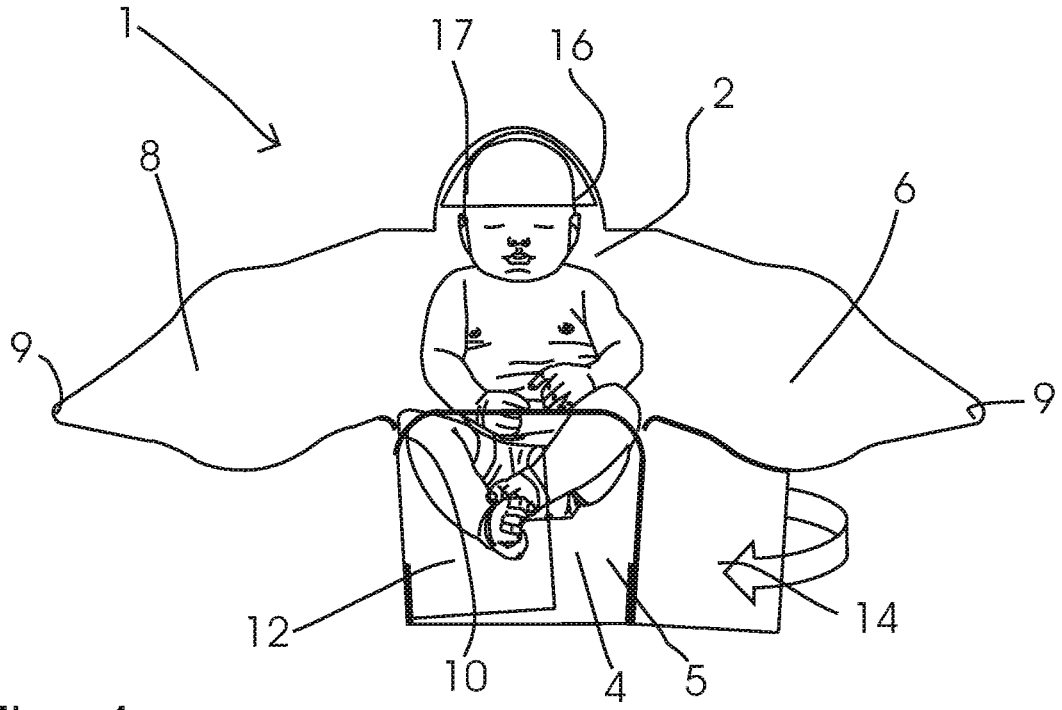
FIG. 4: garment with newborn and a wrapped wrap element.
Figure 5:
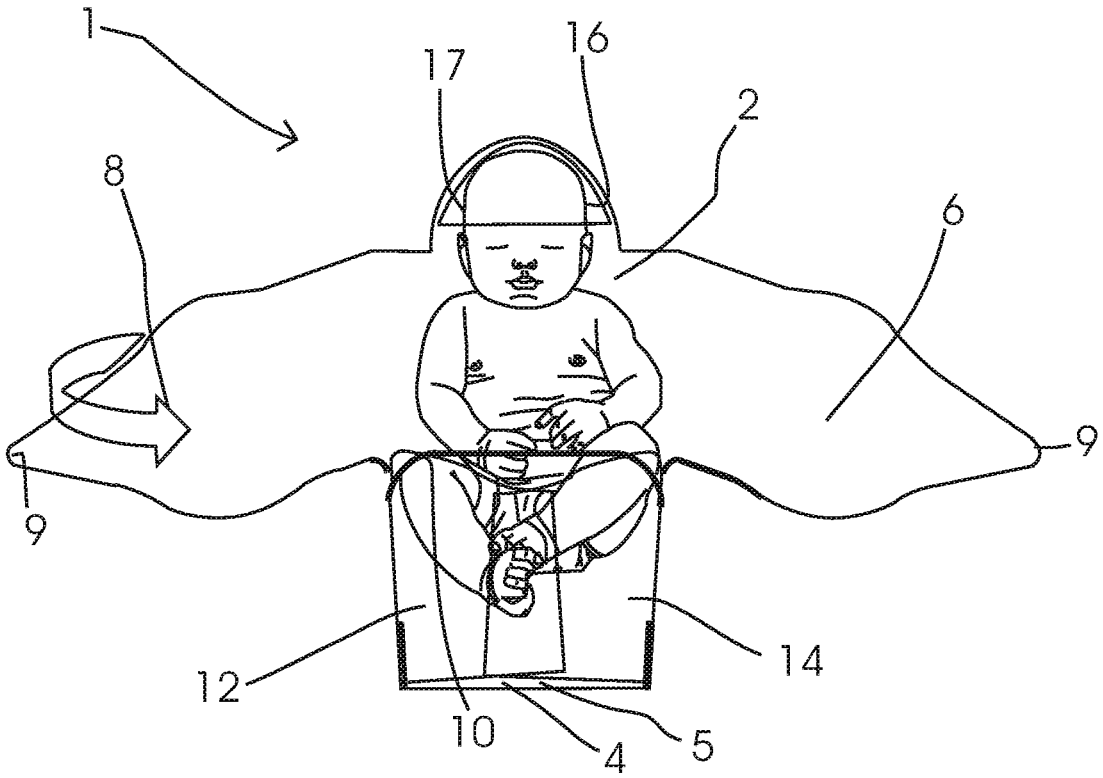
FIG. 5: garment with newborn and two wrapped wrap elements.
Figure 6:
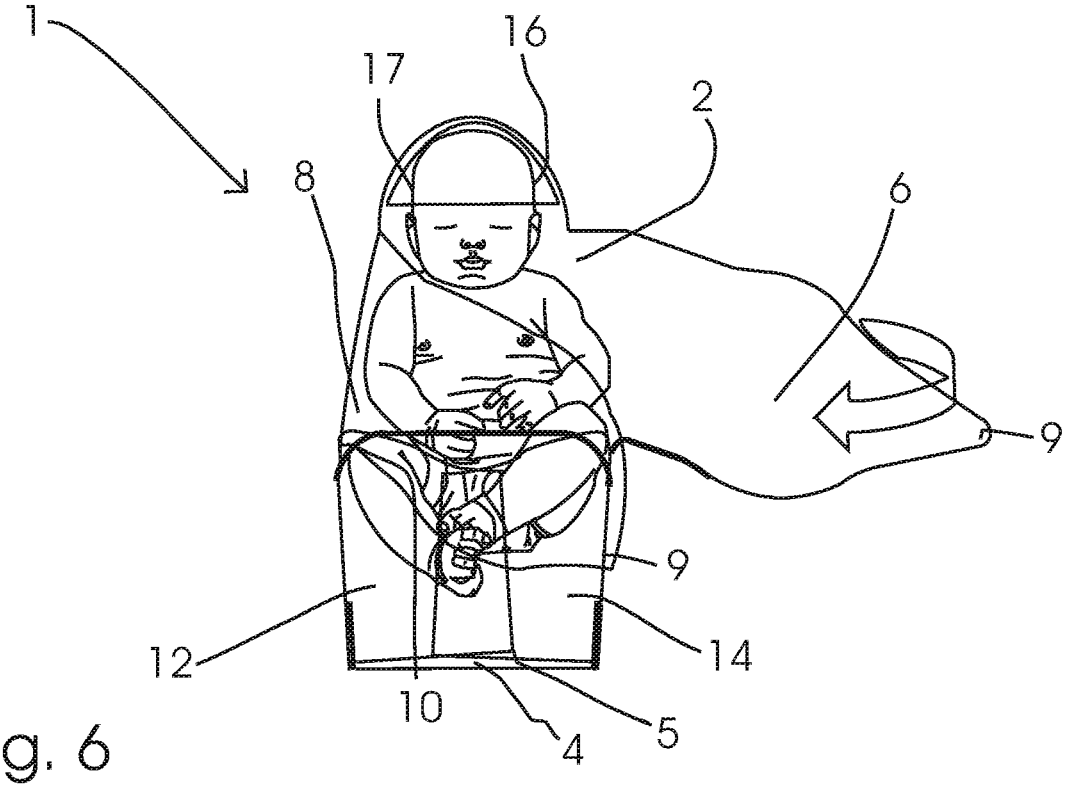
FIG. 6: garment with newborn and two wrapped wrap elements and a wrapped wing element.
Figure 7:
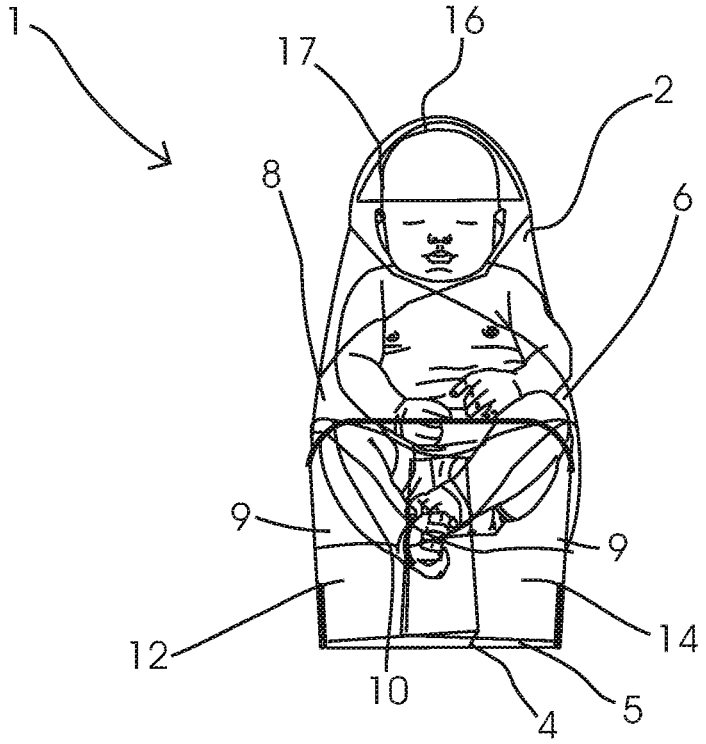
FIG. 7: garment with wrapped wing elements and wrapped wrap elements.

FIGS. 3-7 show, in succession, how a newborn 3 can be swathed in the garment 1. In FIG. 3, the newborn 3 is placed here with its legs inside the pouch element underneath the leg-cover portion 5, whilst the head is arranged underneath the head-cover portion 17 in the hood element. An arrow indicates the movement required to arrive at the subsequent FIG. 4. For this, a wrap element 12 has to be folded over the legs. It is also possible here for the newborn to be arranged on top of the leg-cover portion 5. In the next step, the second wrap element 14 is folded over the legs to arrive at the illustration in FIG. 5. Irrespective of whether the legs of the newborn 3 are underneath or on top of the leg-cover portion 5, they are thus covered at least by the wrap elements 12, 14. In the next step, a wing element 8 is folded over to arrive at FIG. 6. In the next step, a second wing element 6 is folded over to arrive at the illustration in FIG. 7.

Figure 8:
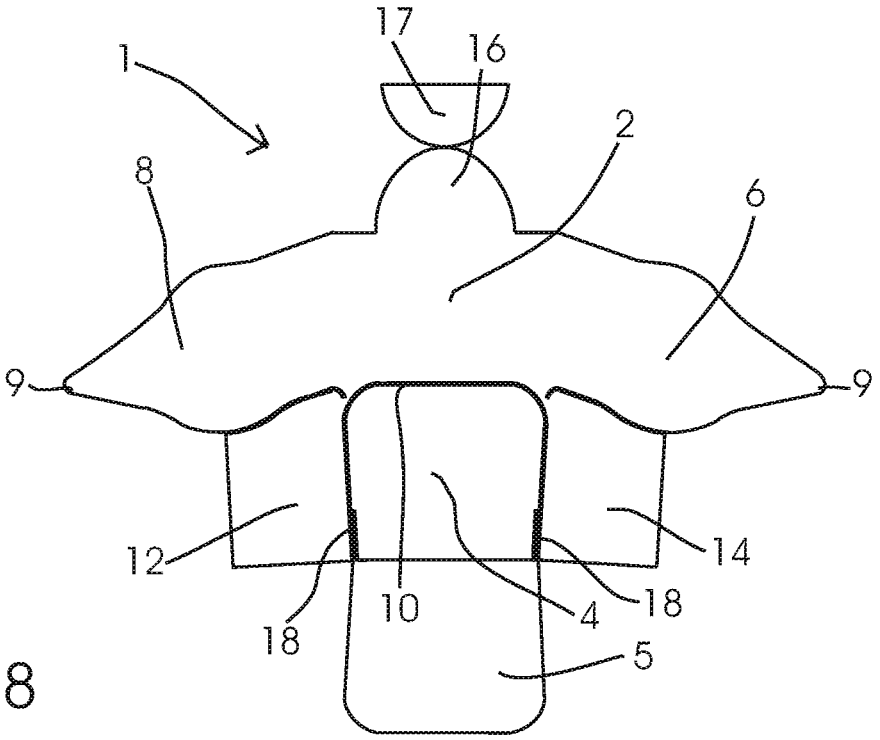
FIG. 8: garment without newborn with separated seams in a film plane.
Figure 9:
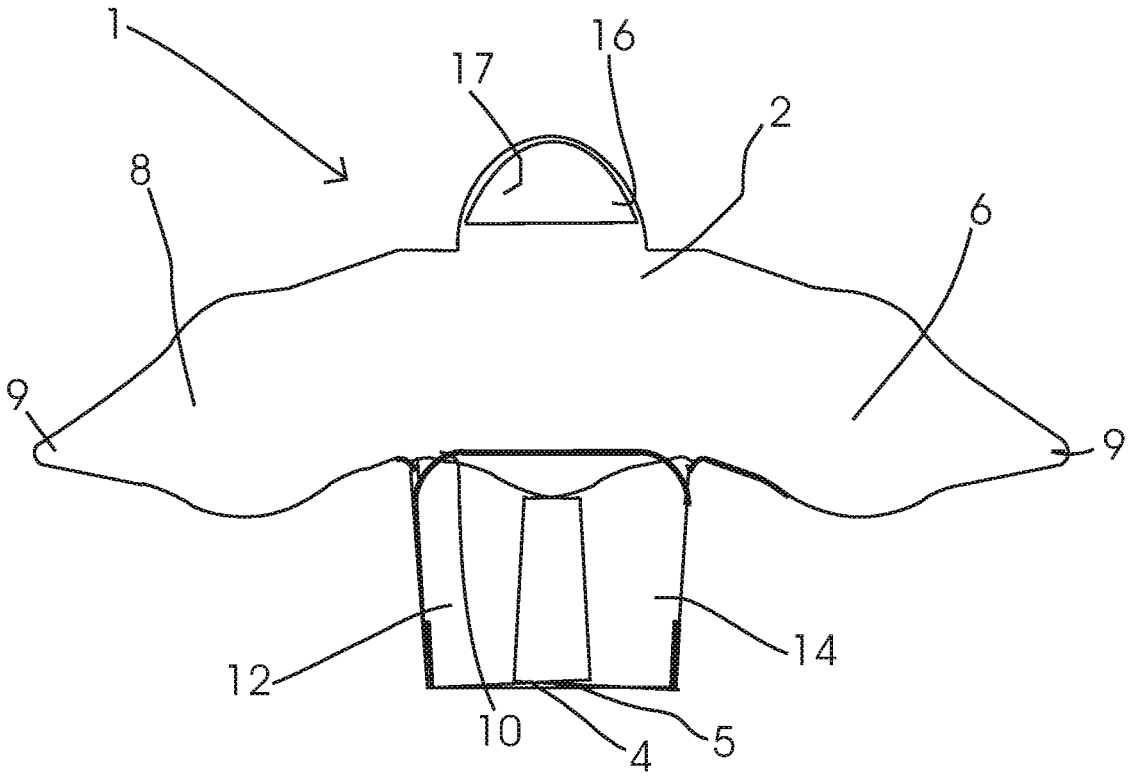
FIG. 9: garment without newborn with wrapped wrap elements.

FIG. 8 shows the garment 1 with separated seams so that both the leg-cover portion 5 and also the head-cover portion 17 are in an opened-up state. The function of the pouch fold point 45 is particularly clear here. In FIG. 9, the wrapped wrap elements 12, 14 are again shown on the garment 1 without a newborn 3.

All of the features disclosed in the application documents are claimed as important for the invention insofar as they are novel over the prior art individually or in combination. While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

LIST OF REFERENCES

1. garment
2 back portion
3 newborn
4 leg portion
5 leg-cover portion
6, 8 wing elements
9 wing tip
10 opening
12, 14 wrap elements
16. head portion
17. head-cover portion
18. pouch seam
21, 23 shoulder edge
45 pouch fold point
63, 83 inner upper wing edge
65, 85 rounded upper wing edge
67, 87 outer upper wing edge
71, 91 outer lower wing edge
73, 93 rounded lower wing edge
75, 95 inner lower wing edge
77, 97 lower wing edge curve

101 lateral upper pouch edge curve
103 lateral pouch edge
122 lateral edge of the wrap element
124 lower edge of the wrap element
142 lateral edge of the wrap element
144 lower edge of the wrap element
161 hood seam The embodiments of the invention in which an exclusive property or privilege is claimed are defined as follows:

1. A garment (1) for a newborn (3), the garment comprising: a film material, wherein the garment is made from the film material, a back portion (2) to be placed under a back, a leg portion (4) for placing under legs and two wing elements (6, 8) for swathing a chest region, an arm region and an abdominal region of the newborn (3), wherein the leg portion (4) is arranged adjacent to the back portion (2) and the two wing elements (6, 8) are each respectively arranged adjacent to the back portion (2) on a respective arm side, wherein the wing elements (6, 8) are each formed such that a respective one of the wing elements (6, 8) can be wrapped from the back portion (2) on the respective arm side over a respective arm of the newborn (3) so that the respective arm with a respective neighboring shoulder, the abdominal region and the chest of the newborn (3) are completely covered by the respective wing element (6, 8);

the head-to-toe extent of the wing elements (6, 8) increases in an outwards direction from the back portion (2) on the respective arm side to between a rounded lower edge (73, 93) and a rounded upper wing edge (65, 85) where the wing elements (6, 8) have a greatest head-to-toe extent of the respective wing element (6, 8), and then converge in each case to form a respective wing tip (9), whereby the film material is transparent; and characterized in that an inside surface of the garment (1) is populated by physiological microorganisms.

2. A garment (1) for a newborn (3), the garment comprising: a film material, wherein the garment is made from the film material, a back portion (2) to be placed under a back, a leg portion (4) for placing under legs and two wing elements (6, 8) for swathing a chest region, an arm region and an abdominal region of the newborn (3), wherein the leg portion (4) is arranged adjacent to the back portion (2) and the two wing elements (6, 8) are arranged adjacent to the back portion (2) on a respective arm side, wherein the wing elements (6, 8) are each formed such that a respective one of the wing elements (6, 8) can be wrapped from the back portion (2) on the respective arm side over a respective arm of the newborn (3) so that the respective arm with a respective neighboring shoulder, the abdominal region and the chest of the newborn (3) are completely covered by the respective wing element (6, 8);

the head-to-toe extent of the wing elements (6, 8) increases in an outwards direction from the back portion (2) on the respective arm side to between a rounded lower edge (73, 93) and a rounded upper wing edge (65, 85) where the wing elements (6, 8) have a greatest head-to-toe extent of the respective wing element (6, 8), and then converge in each case to form a respective wing tip (9);

the film material is plastic, is impermeable to water vapor, and is configured for long-term contact with the skin of the newborn; and the garment further comprises:

a head portion (16) configured to be placed under a head of the newborn (3), wherein the head portion is arranged adjacent to the back portion (2) and includes a head-cover portion (17) as a hood element, the head-cover portion including an opening facing the back portion (2) for inserting the head of the newborn (3); and wrap elements (12, 14) arranged on the leg portion (4) on respective ones of the arm sides for the purpose of optionally swathing the legs of the newborn (3) in an accessible manner.

3. A garment (1) for a newborn (3) according to claim 2, characterized in that the wrap elements (12, 14) extend outwards from the leg portion (4) on the respective arm side to such an extent that the wrap elements (12, 14) overlap when they are wrapped towards the center over a leg-cover portion (5) so that the legs of the newborn (3) can also be accommodated in the space between the leg-cover portion (5) and the wrap elements (12, 14) and are externally accessible on a foot side of the garment (1).

4. A garment (1) for a newborn (3) according to claim 2, characterized in that the wing elements (6, 8) overlap the wrap elements (12, 14) in the wrapped state so that the arm, shoulder, chest, abdominal and leg regions of the newborn (3) are also completely covered when the legs are accommodated in the space between the leg-cover portion (5) and the wrap elements (12, 14).

5. A garment (1) for a newborn (3), the garment comprising: a film material, wherein the garment is made from the film material, a back portion (2) to be placed under a back, a leg portion (4) for placing under legs and two wing elements (6, 8) for swathing a chest region, an arm region and an abdominal region of the newborn (3), wherein the leg portion (4) is arranged adjacent to the back portion (2) and the two wing elements (6, 8) are arranged adjacent to the back portion (2) on a respective arm side, wherein the wing elements (6, 8) are each formed such that a respective one of the wing elements (6, 8) can be wrapped from the back portion (2) on the respective arm side over a respective arm of the newborn (3) so that the respective arm with a respective neighboring shoulder, the abdominal region and the chest of the newborn (3) are completely covered by the respective wing element (6, 8);

the head-to-toe extent of the wing elements (6, 8) increases in an outwards direction from the back portion (2) on the respective arm side to between a rounded lower edge (73, 93) and a rounded upper wing edge (65, 85) where the wing elements (6, 8) have a greatest head-to-toe extent of the respective wing element (6, 8), and then converge in each case to form a respective wing tip (9);

the film material is plastic, is impermeable to water vapor, and is configured for long-term contact with the skin of the newborn; and characterized in that an inside surface of the garment (1) is populated by physiological microorganisms.

* * * * *